US010019954B2

(12) United States Patent
Kim et al.

(10) Patent No.: US 10,019,954 B2
(45) Date of Patent: Jul. 10, 2018

(54) LIQUID CRYSTAL DISPLAY DEVICE AND DRIVING METHOD THEREOF

(71) Applicant: Samsung Display Co., Ltd., Yongin-si (KR)

(72) Inventors: Won-Tae Kim, Yongin-si (KR); Sun-Koo Kang, Yongin-si (KR); Jae-Han Lee, Yongin-si (KR); Sun-Kyu Son, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 296 days.

(21) Appl. No.: 14/849,142

(22) Filed: Sep. 9, 2015

(65) Prior Publication Data

US 2016/0133210 A1 May 12, 2016

(30) Foreign Application Priority Data

Nov. 12, 2014 (KR) ..... 10-2014-0157397

(51) Int. Cl.
*G09G 3/36* (2006.01)

(52) U.S. Cl.
CPC ..... *G09G 3/3614* (2013.01); *G09G 3/3648* (2013.01); *G09G 2360/16* (2013.01)

(58) Field of Classification Search
CPC . G09G 3/3614; G09G 3/3648; G09G 2360/16
See application file for complete search history.

(56) References Cited

U.S. PATENT DOCUMENTS

| | | | | |
|---|---|---|---|---|
| 6,320,566 | B1 | 11/2001 | Go | |
| 8,339,425 | B2 | 12/2012 | Shin et al. | |
| 2009/0027425 | A1* | 1/2009 | Park | G09G 3/3607 345/690 |
| 2009/0309867 | A1* | 12/2009 | Shin | G09G 3/3614 345/214 |
| 2011/0032224 | A1* | 2/2011 | Hirakata | G09G 3/3614 345/204 |
| 2014/0267212 | A1* | 9/2014 | Li | G09G 3/3614 345/212 |

FOREIGN PATENT DOCUMENTS

| | | |
|---|---|---|
| KR | 10-1998-0078805 | 11/1998 |
| KR | 10-2005-0113853 | 12/2005 |
| KR | 10-2006-0077952 | 7/2006 |
| KR | 10-2009-0073468 | 7/2009 |
| KR | 10-2009-0131039 | 12/2009 |

* cited by examiner

*Primary Examiner* — Aneeta Yodichkas
(74) *Attorney, Agent, or Firm* — H.C. Park & Associates, PLC

(57) ABSTRACT

A liquid crystal display device, including: pixels; data lines and scan lines coupled to the pixels; and a driver configured to supply a scan signal to the scan lines, and supply a data voltage to the data lines. The data lines include first to third data lines, to which a data voltage having a positive polarity is supplied, and which are adjacent to each other, and fourth to sixth data lines, to which a data voltage having a negative polarity is supplied, and which are adjacent to each other.

10 Claims, 5 Drawing Sheets

FIG. 3A

| ENTIRE | DIVISION | D1 | D2 | D3 | D4 | D5 | D6 |
|---|---|---|---|---|---|---|---|
| PInfo | PInfo1 | + | + | + | − | − | − |
| | PInfo2 | − | + | + | + | − | − |
| | PInfo3 | − | − | + | + | + | − |
| | PInfo4 | − | − | − | + | + | + |
| | PInfo5 | + | − | − | − | + | + |
| | PInfo6 | + | + | − | − | − | + |

FIG. 3B

| ENTIRE | DIVISION | D1 | D2 | D3 | D4 | D5 | D6 |
|---|---|---|---|---|---|---|---|
| Pinfo' | Pinfo'1 | + | + | − | − | + | + |
| | Pinfo'2 | − | + | + | − | − | + |
| | Pinfo'3 | − | − | + | + | − | − |
| | Pinfo'4 | + | − | − | + | + | − |

LIQUID CRYSTAL DISPLAY DEVICE AND DRIVING METHOD THEREOF

CROSS-REFERENCE TO RELATED APPLICATION

This application claims priority from and the benefit of Korean Patent Application No. 10-2014-0157397, filed on Nov. 12, 2014, which is hereby incorporated by reference for all purposes as if fully set forth herein.

BACKGROUND

Field

Exemplary embodiments relate to a liquid crystal display device, in which a data voltage supplied to a data line has either a positive polarity or a negative polarity, and a driving method thereof.

Discussion of the Background

Various flat panel displays have recently been developed as alternatives to a relatively heavy and bulky cathode ray tube (CRT) display. The flat panel displays include a liquid crystal display (LCD), a field emission display (FED), a plasma display panels (PDP), an organic light emitting display (OLED), and the like.

For the LCD device, it is advantageous to improve a ratio (transmissivity) of luminance of light reaching a user to luminance of light emitted from a backlight. In order to improve transmissivity, a method has been developed in which red (R), green (G), blue (B), and white (W) pixels form one pixel group and light emitted in an area corresponding to a white (W) pixel part reaches the user without passing through a color filter.

Further, the liquid crystal display device is driven by a difference in a voltage between two electrodes (a pixel electrode and a common electrode) supplied to both terminals of liquid crystal. When a voltage level supplied to the pixel electrode is higher than a voltage level supplied to the common electrode, a polarity of a data voltage supplied to the pixel electrode is referred to as having "positive polarity". When a voltage level supplied to the pixel electrode is lower than a voltage level supplied to the common electrode, a polarity of a data voltage supplied to the pixel electrode is referred to as having "negative polarity".

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a liquid crystal display device, in which a polarity of a data voltage supplied to a data line is a positive polarity or a negative polarity, and a driving method thereof.

Additional aspects will be set forth in the detailed description which follows, and, in part, will be apparent from the disclosure, or may be learned by practice of the inventive concept.

An exemplary embodiment discloses a liquid crystal display device, including: pixels; data lines and scan lines coupled to the pixels; and a driver configured to supply a scan signal to the scan lines, and to supply a data voltage to the data lines. The data lines include first to sixth data lines, which are adjacent to each other, and in a first frame, a polarity of the data voltage supplied to each of the first to third data lines has a positive polarity, and the data voltage supplied to each of the fourth to sixth data lines has a negative polarity An exemplary embodiment also discloses a method of driving a liquid crystal display device including: determining a driving mode; and driving the liquid crystal display device in a first mode, in which the driving of the liquid crystal display device in the first mode includes: determining polarity information corresponding to data lines; receiving image data from the outside; and determining levels of data voltages supplied to the data lines based on the polarity information and the image data, and supplying the data voltage, of which the level is determined, to the data lines. In a first frame displayed by the supplying of the data voltage to the data lines, the data voltage supplied to each of the first to third data lines among the first to sixth data lines has a positive polarity, and the data voltage supplied to each of the fourth to sixth data lines has a negative polarity.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

FIG. 3A and FIG. 3B are diagrams for describing polarity information output from a polarity information output unit illustrated in FIG. 1A.

DETAILED DESCRIPTION OF THE ILLUSTRATED EMBODIMENTS

Figure 1A:
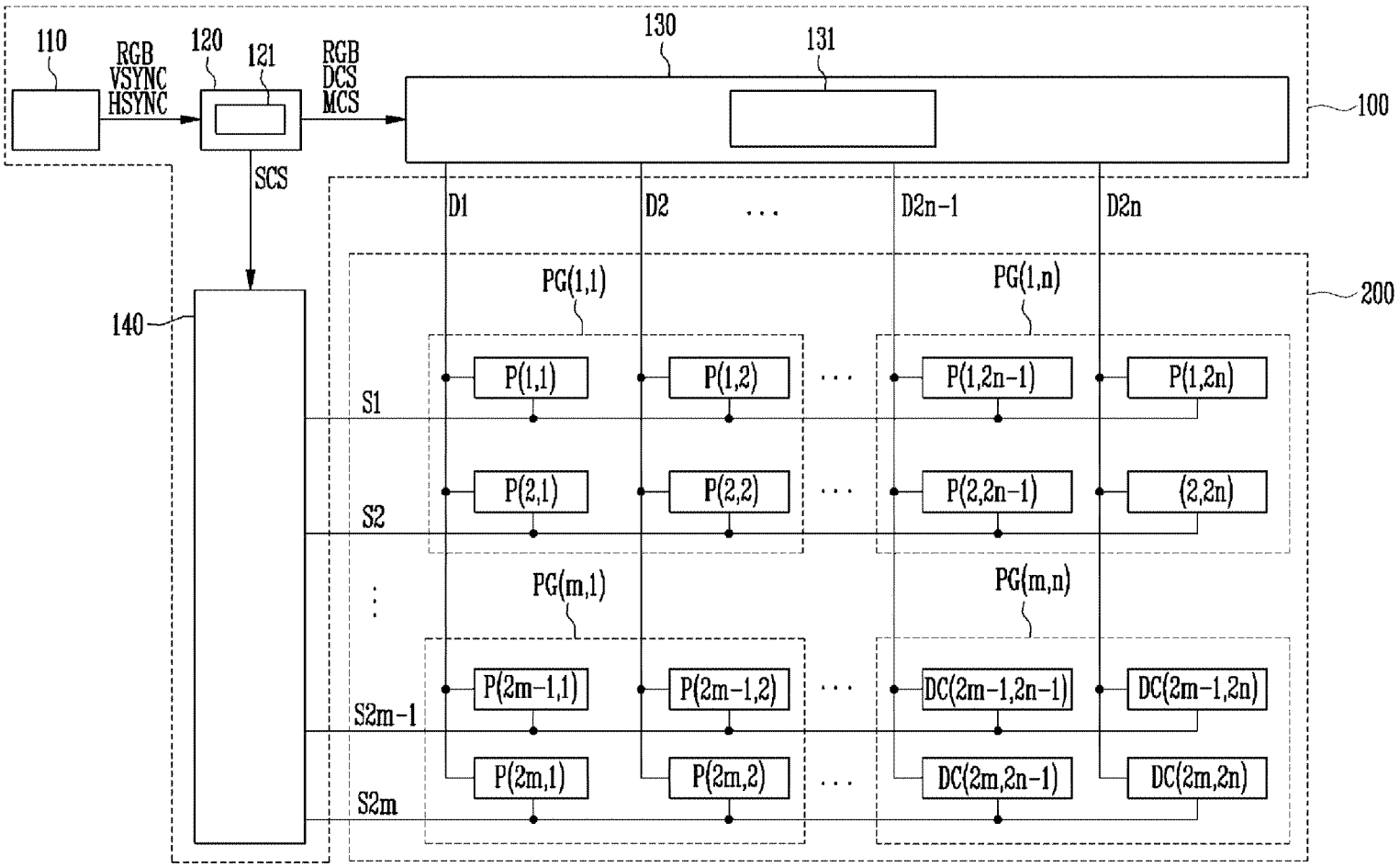
FIG. 1A is a diagram for describing a liquid crystal display device according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. It will also be understood that when an element is referred to as being "between" two elements, it may be the only element between the two elements, or one or more intervening elements may also be present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

FIG. 1A is a diagram for describing a liquid crystal display device according to an exemplary embodiment of the present invention. Referring to FIG. 1A, a liquid crystal display device includes a driver 100 and a display panel 200.

The driver 100 may include a host 110, a timing controller 120, a data driver 130, and a scan driver 140.

The host 110 receives a signal from the outside and provides the received signal to the timing controller 120. The host 110 includes a system on chip, including a scaler therein. The host 110 may provide an image data RGB, a vertical synchronization signal VSYNC, and a horizontal synchronization signal HSYNC to the timing controller 120. The image data RGB may include gray levels corresponding to pixels P(1,1) to P(2*m*, 2*n*) (m and n are positive integers) within the display panel 200, respectively.

The timing controller 120 receives the synchronization signals VSYNC and HSYNC from the host 110 and generates timing control signals DCS and SCS for controlling operation timing of a data driver 130 and a scan driver 140. Further, the timing controller 120 outputs the image data RGB to the data driver 130 so that the display panel 200 may display an image. The timing controller 120 may include a mode determination unit 121. The mode determination unit 121 outputs a mode control signal MCS. When the mode control signal MCS has a first logic value, the liquid crystal display device is driven in a first mode, and when the mode control signal MCS has a second logic value, the liquid crystal display device is driven in a second mode. The mode determination unit 121 may be embedded in the timing controller 120 in the form of software. In an exemplary embodiment, referring to FIG. 1A, the mode determination unit 121 is included in the timing controller 120, but may instead be included in the host 110 or the data driver 130. Otherwise, a signal from the outside may also be included in the mode control signal.

The data driver 130 latches the image data RGB input from the timing controller 120 in response to a data timing control signal DCS. The data driver 130 may include a plurality of source drive ICs. The data driver 130 includes a polarity information output unit 131. The polarity information output unit 131 outputs polarity information based on the logic value of the mode control signal MCS, and the data driver 130 supplies a data voltage to data lines D1 to D2*n* based on the image data RGB and the polarity information. For example, for the data line D1, when a data voltage corresponding to the data line D1 has a positive polarity, a level of a common voltage is 1 V (volt), and a voltage level corresponding to a gray level of the data line D1 is 2 V, a level of the data voltage supplied to the data line D1 is 3 V (1 V+2 V). The polarity information output unit 131 may also output pre-stored polarity information, or otherwise calculate polarity information and output the calculated polarity information in real time. The polarity information output unit 131 may be embedded in the data driver 130 in the form of software, or may also be included in the timing controller 120 or the host 110, instead of the data driver 130. The polarity information will be described in detail with reference to FIG. 3A and FIG. 3B below.

The scan driver 140 supplies a scan signal to scan lines S1 to S2*m* in response to a scan timing control signal for each frame.

The display panel 200 includes pixels P(1,1) to P(2*m*,2*n*) (hereinafter, referred to as "P"), scan lines S1 to S2*m* (hereinafter referred to as "S"), and data lines D1 to D2*n* (hereinafter referred to as "D"), which are electrically coupled to the pixels P. Each pixel P is included in one of the pixel groups PG(1,1) to PG(m,n) (hereinafter, referred to as "PG"). The pixels P(1,1), P(1,2), P(2,1), and P(2,2) included in the pixel group PG(1,1) display different colors from each other.

Figure 1B:
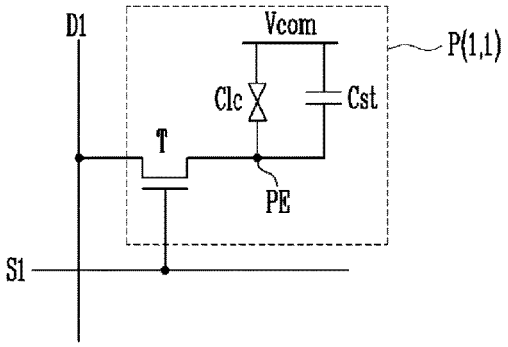
FIG. 1B is a diagram for describing an exemplary embodiment of a pixel illustrated in FIG. 1A.

FIG. 1B is a diagram for describing an exemplary embodiment of the pixel illustrated in FIG. 1A. The pixel P(1,1) electrically coupled to the scan line S1 and the data line D1 is illustrated in FIG. 1B. Referring to FIG. 1B, the pixel P(1,1) includes a transistor T, a liquid crystal cell Clc, a storage capacitor Cst, and a pixel electrode PE.

The transistor T is disposed between the data line D1 and the pixel electrode PE, and a gate electrode thereof is coupled to the scan line S1. The liquid crystal cell Clc is driven by a difference in a voltage between the pixel electrode PE and the common electrode Vcom. The storage capacitor Cst is disposed between the common electrode Vcom and the pixel electrode PE, and maintains a difference in a voltage between the pixel electrode PE and the common electrode Vcom for a predetermined period of time.

Figure 2:
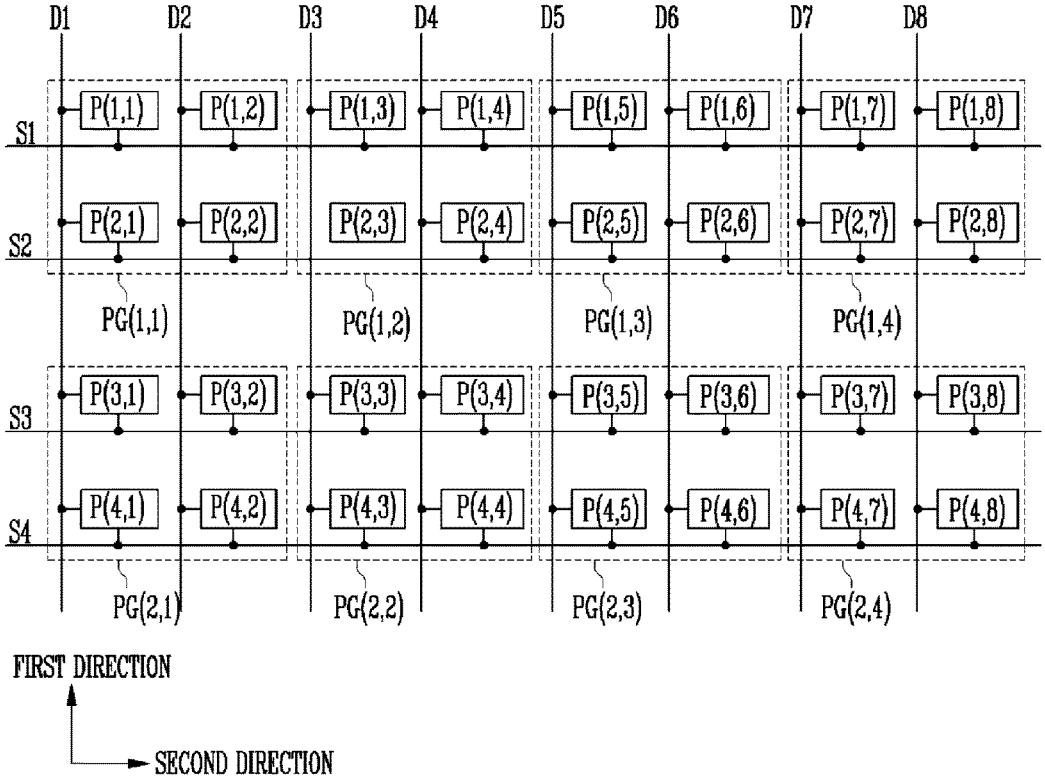
FIG. 2 is a diagram for describing an exemplary embodiment of a pixel group illustrated in FIG. 1A.

FIG. 2 is a diagram for describing one exemplary embodiment of a pixel group illustrated in FIG. 1A. Hereinafter, the pixel group will be described with reference to FIG. 1A and FIG. 2. In FIG. 2, eight pixel groups PG(1,1) to PG(2,4) are illustrated. The data lines D1 to D8 extend in a first direction, and the scan lines S1 to S4 extend in a second direction crossing the first direction.

Each of the pixel groups PG(1,1) to PG(2,4) includes four pixels. As an example, the pixel group PG(1,1) includes a first pixel P(1,1) for displaying a first color, a second pixel P(1,2), which displays a second color, is coupled to the same scan line S1 as that of the first pixel P(1,1), and is adjacent to the first pixel P(1,1) in the second direction, a third pixel P(2,1), which displays a third color, is coupled to the same data line D1 as that of the first pixel P(1,1), and is adjacent to the first pixel P(1,1) in the first direction, and a fourth pixel P(2,2), which displays a fourth color, is coupled to the same data line D2 as that of the second pixel P(2,1), and the same scan line S2 as that of the third pixel P(2,1). Here, the first color, the second color, the third color, and the fourth color may be red, green, blue, and white (R, G, B, and W).

The pixel group PG(2,1) adjacent to the pixel group PG(1,1) in the first direction includes a first pixel P(3,1), a second pixel P(3,2), a third pixel P(4,1), and a fourth pixel P(4,2). The data line D1 coupled to the first pixel P(1,1) of the pixel group PG(1,1) is also coupled to the first pixel P(3,1) of the pixel group PG(2,1).

The pixel group PG(1,2) adjacent to the pixel group PG(1,1) in the second direction includes a first pixel P(2,3) for displaying the first color, a second pixel P(2,4) for displaying a second color, a third pixel P(1,3) for displaying a third color, and a fourth pixel P(1,4) for displaying a fourth color. The scan line S1 coupled to the first pixel P(1,1) of the pixel group PG(1,1) is adjacent to the scan line S2 coupled to the first pixel P(2,3) of the pixel group PG(1,2).

The pixel groups PG(1,1) to PG(2,4) displayed in FIG. 2 include the first pixels P(1,1), P(2,3), P(1,5), P(2,7), P(3,1), P(4,3), P(3,5), and P(4,7) for displaying the first color, the second pixels P(1,2), P(2,4), P(1,6), P(2,4), P(3,2), P(4,4), P(3,6), and P(4,8) for displaying the second color, the third pixels P(2,1), P(1,3), P(2,5), P(1,7), P(4,1), P(3,3), P(4,5), and P(3,7) for displaying the third color, and the fourth pixels P(2,2), P(1,4), P(2,6), P(1,8), P(4,2), P(3,4), P(4,6), and P(3,8) for displaying the fourth color.

FIG. 3A and FIG. 3B are diagrams for describing polarity information output from the polarity information output unit illustrated in FIG. 1A.

FIG. 3A is a diagram for describing polarity information when the mode control signal MCS having the first logic value is output by the mode determination unit 121. When the mode determination unit 121 outputs the mode control signal MCS having the first logic value, the liquid crystal display device is driven in the first mode. One of six elements of polarity information PInfo1 to PInfo6 constituting a polarity information group PInfo is output from the polarity information output unit 131. For example, when the polarity information PInfo1 is output, a part corresponding to D1 in the polarity information PInfo1 is indicated by "+". This means that the data voltage to be supplied to the data line D1 has a positive polarity. A part corresponding to D4 in the polarity information PInfo1 is indicated by "−". This means that the data voltage to be supplied to the data line D4 has a negative polarity. Polarities of the data voltages supplied to the data lines D are determined based on the polarity information PInfo1.

The polarity information PInfo1 may be output from the polarity information output unit 131. In a first frame displayed based on the polarity information PInfo1 and the image data RGB, the data voltage supplied to each of the first to third data lines D1 to D3 has a positive polarity (+), and the data voltage supplied to each of the fourth to sixth data lines D4 to D6 has a negative polarity (−).

The polarity information PInfo2 may be output from the polarity information output unit 131 right after the first frame is displayed. Right after the first frame, in a second frame displayed based on the polarity information PInfo2 and the image data RGB, the data voltage supplied to each of the second to fourth data lines D2 to D4 has a positive polarity (+), and the data voltage supplied to each of the first, fifth, and sixth data lines D1, D5, and D6 has a negative polarity (−).

The polarity information PInfo3 may be output from the polarity information output unit 131 right after the second frame is displayed. Right after the second frame, in a third frame displayed based on the polarity information PInfo3 and the image data RGB, the data voltage supplied to each of the third to fifth data lines D3 to D5 has a positive polarity (+), and the data voltage supplied to each of the first, second, and sixth data lines D1, D2, and D6 has a negative polarity (−).

The polarity information PInfo4 may be output from the polarity information output unit 131 right after the third frame is displayed. Right after the third frame, in a fourth frame displayed based on the polarity information PInfo4 and the image data RGB, the data voltage supplied to each of the fourth to sixth data lines D4 to D6 has a positive polarity (+), and the data voltage supplied to each of the first to third data lines D1 to D3 has a negative polarity (−).

The polarity information PInfo5 may be output from the polarity information output unit 131 right after the fourth frame is displayed. Right after the fourth frame, in a fifth frame displayed based on the polarity information PInfo5 and the image data RGB, the data voltage supplied to each of the first, fifth, and sixth data lines D1, D5, and D6 has a positive polarity (+), and the data voltage supplied to each of the second to fourth data lines D2 to D4 has a negative polarity (−).

The polarity information PInfo6 may be output from the polarity information output unit 131 right after the fifth frame is displayed. Right after the fifth frame, in a sixth frame displayed based on the polarity information PInfo6 and the image data RGB, the data voltage supplied to each of the first, second, and sixth data lines D1, D2, and D6 has a positive polarity (+), and the data voltage supplied to each of the third to fifth data lines D3 to D5 has a negative polarity (−).

A seventh frame displayed right after the display of the sixth frame is displayed based on the polarity information PInfo1 and the image data RGB. That is, the polarity information is repeated on a cycle of six frames. In the polarity information illustrated in FIG. 3A, the polarity of the data voltage supplied to the data line Da+6 (a is a positive integer) may be the same as that of the data line Da. For example, the polarity of the data voltage supplied to the seventh data line D7 is the same as the polarity of the data voltage supplied to the first data line D1, and the polarity of the data voltage supplied to the eighth data line D8 is the same as the polarity of the data voltage supplied to the second data line D2.

Hereinafter, a description will be given additionally referring to FIG. 2. Whether a line extended in the first direction or the second direction is visible to a user by the polarity information group PInfo will be described based on the first pixels P(1,1), P(2,3), P(1,5), P(2,7), P(3,1), P(4,3), P(3,5), and P(4,7) for displaying the first color as an example. For example, it is defined that when all of the data voltages supplied to the first pixels P(1,1) and P(3,1) coupled to the data line D1 have a first polarity (positive or negative), and all of the data voltages supplied to the first pixels P(2,3) and P(4,3) coupled to the data line D3 have a second polarity (other than the first polarity), a line extending in the first direction and positioned between the data line D1 and the data line D3 is visible to a user. It is defined that when all of the data voltages supplied to the first pixels P(1,1) and P(1,5) coupled to the scan line S1 have the first polarity, and when all of the data voltages supplied to the first pixels P(2,3) and P(2,7) coupled to the scan line S2 have the second polarity, a line positioned extending in the second direction between the scan line S1 and the scan line S2 is viewed by the user. The data lines D1 and D3, and the scan lines S1 and S2, are illustrative.

In the first frame, the data voltage is supplied based on the polarity information PInfo1, the data voltages supplied to the pixels P(1,1), P(2,3), P(2,7), P(3,1), P(4,3), and P(4,7) have the positive polarity, and the data voltages supplied to the pixels P(1,5) and P(3,5) have the negative polarity. The lines extending in the first direction between the data line D3 and the data line D5, and the data line D5 and the data line D7, may be visible to the viewer, and the line extended in the second direction is not visible to the user.

In the second frame displayed right after the first frame, the data voltage is supplied based on the polarity information PInfo2, the data voltages supplied to the pixels P(2,3) and P(4,3) have a positive polarity, and the data voltages supplied to the pixels P(1,1), P(1,5), P(2,7), P(3,1), P(3,5), and P(4,7) have a negative polarity. The lines extending in the first direction between the data line D1 and the data line D3, and the data line D3 and the data line D5, may be visible to the user. The line extending in the second direction is not visible to the user.

In the third frame displayed right after the second frame, the data voltage is supplied based on the polarity information PInfo3, the data voltages supplied to the pixels P(2,3), P(1,5), P(4,3), and P(3,5) have a positive polarity, and the data voltages supplied to the pixels P(1,1), P(2,7), P(3,1), P(4,7) have a negative polarity. The lines extending in the first direction between the data line D1 and the data line D3, and the data line D5 and the data line D7, may be visible to the viewer, and the line extending in the second direction is not visible to the user.

In the fourth frame displayed right after the third frame, the data voltage is supplied based on the polarity information PInfo4, the data voltages supplied to the pixels P(1,5) and P(3,5) have a positive polarity, and the data voltages supplied to the pixels P(1,1), P(2,3), P(2,7), P(3,1), P(4,3), and P(4,7) have a negative polarity. The lines extending in the first direction between the data line D3 and the data line D5, and the data line D5 and the data line D7, may be visible to the viewer, and the line extending in the second direction is not visible to the user.

In the fifth frame displayed right after the fourth frame, the data voltage is supplied based on the polarity information PInfo5, the data voltages supplied to the pixels P(1,1), P(1,5), P(2,7), P(3,1), P(3,5), and P(4,7) have a positive polarity, and the data voltages supplied to the pixels P(2,3), P(4,3) have a negative polarity. The lines extending in the first direction between the data line D1 and the data line D3, and the data line D3 and the data line D5, may be visible to the user. The line extending in the second direction is not visible to the user.

In the sixth frame displayed right after the fifth frame, the data voltage is supplied based on the polarity information PInfo6, the data voltages supplied to the pixels P(1,1), P(2,7), P(3,1), and P(4,7) have a positive polarity, and the data voltages supplied to the pixels P(2,3), P(1,5), P(4,3), and P(3,5) have a negative polarity. The lines extending in the first direction between the data line D1 and the data line D3, and the data line D5 and the data line D7, may be visible to the viewer, and the line extending in the second direction is not viewed to the user.

In the first to sixth frames, the line extending in the second direction is not visible to the user, and the line extending in the first direction is visible to the user. The line extending in the first direction between the data line D1 and the data line D3 is visible only in the second, third, fifth, and sixth frames. That is, the line is visible for four frames out of sixth frames, and the line is not visible for two frames.

FIG. 3B is a diagram for describing polarity information when the mode control signal MCS having the second logic value is output by the mode determination unit 121. When the mode determination unit 121 outputs the mode control signal MCS having the second logic value, the liquid crystal display device is driven in the second mode. The polarity information output unit 131 outputs one of four elements of polarity information PInfo'1 to PInfo'4 constituting a polarity information group PInfo'. General contents of the polarity information have been already described with reference to FIG. 3A.

The polarity information PInfo'1 may be output from the polarity information output unit 131. In a first frame displayed based on the polarity information PInfo'1 and the image data RGB, the data voltage supplied to each of the first, second, fifth, and sixth data lines D1, D2, D5, and D6 has a positive polarity (+), and the data voltage supplied to each of the third and fourth data lines D3 to D4 has a negative polarity (−). Polarities of the data voltages supplied to the data lines D are determined based on the polarity information PInfo'1.

The polarity information PInfo'2 may be output from the polarity information output unit 131 right after the first frame is displayed. In a second frame displayed right after the display of the first frame, a data voltage is supplied to the polarity information PInfo'2, the data voltage supplied to each of the second, third, and sixth data lines D2, D3, and D6 have a positive polarity (+), and the data voltage supplied to each of the first, fourth, and fifth data lines D1, D4 and D5 have a negative polarity (−).

The polarity information PInfo'3 may be output from the polarity information output unit 131 right after the second frame is displayed. In a third frame displayed right after the display of the second frame, a data voltage is supplied to the polarity information PInfo'3, the data voltage supplied to each of the third and fourth data lines D3 and D4 has a positive polarity (+), and the data voltage supplied to each of the first, second, fifth and sixth data lines D1, D2, D5, and D6 has a negative polarity (−).

The polarity information PInfo'4 may be output from the polarity information output unit 131 right after the third frame is displayed. In a fourth frame displayed right after the display of the third frame, a data voltage is supplied to the polarity information PInfo'4, the data voltage supplied to each of the first, fourth, and fifth data lines D1, D4, and D5 has a positive polarity (+), and the data voltage supplied to each of the second, third, and sixth data lines D2, D3, and D6 has a negative polarity (−).

A fifth frame displayed right after the display of the fourth frame is displayed based on the polarity information PInfo'1 and the image data RGB. That is, the polarity information is repeated with a cycle of four frames. In the polarity information illustrated in FIG. 3B, the data voltage supplied to the data line Da+4 (a is a positive integer) may have the same polarity as that of the data line Da. For example, the polarity of the data voltage supplied to the seventh data line D7 is the same as the polarity of the data voltage supplied to the third data line D3, and the polarity of the data voltage supplied to the eighth data line D8 is the same as the polarity of the data voltage supplied to the fourth data line D4.

Whether a line extending in the first direction or the second direction is visible to a user by the polarity information group PInfo' will be described based on the first pixels P(1,1), P(2,3), P(1,5), P(2,7), P(3,1), P(4,3), P(3,5), and P(4,7) for displaying the first color as an example. The definition of the case where the line extending in the first direction or the second direction may be visible to the user has been described above.

In the first frame, the data voltage is supplied based on the polarity information PInfo1', the data voltages supplied to the pixels P(1,1), P(1,5), P(3,1), and P(3,5) have a positive polarity, and the data voltages supplied to the pixels P(2,3), P(2,7), P(4,3), and P(4,7) have a negative polarity. The lines extending in the first direction between the data line D1 and the data line D3, the data line D3 and the data line D5, and the data line D5 and the data line D7 may be visible to the user, and the lines extended in the second direction between the scan line S1 and the scan line S2, the scan line S2 and the scan line S3, and the scan line S3 and the scan line S4 may be visible to the user.

In the second frame, the data voltage is supplied based on the polarity information PInfo2', the data voltages supplied to the pixels P(2,3), P(2,7), P(4,3), P(4,7) have a positive polarity, and the data voltages supplied to the pixels P(1,1), P(1,5), P(3,1), P(3,5) have a negative polarity. The lines extending in the first direction between the data line D1 and the data line D3, the data line D3 and the data line D5, and the data line D5 and the data line D7 may be visible to the user, and the lines extending in the second direction between the scan line S1 and the scan line S2, the scan line S2 and the scan line S3, and the scan line S3 and the scan line S4 may be visible to the user.

In the third frame, the data voltage is supplied based on the polarity information PInfo3', the data voltages supplied to the pixels P(2,3), P(2,7), P(4,3), P(4,7) have a positive polarity, and the data voltages supplied to the pixels P(1,1), P(1,5), P(3,1), P(3,5) have a negative polarity. The lines extending in the first direction between the data line D1 and the data line D3, the data line D3 and the data line D5, and the data line D5 and the data line D7 may be visible to the user, and the lines extending in the second direction between the scan line S1 and the scan line S2, the scan line S2 and the scan line S3, and the scan line S3 and the scan line S4 may be visible to the user.

In the fourth frame, the data voltage is supplied based on the polarity information PInfo4', the data voltages supplied to the pixels P(1,1), P(1,5), P(3,1), and P(3,5) have a positive polarity, and the data voltages supplied to the pixels P(2,3), P(2,7), P(4,3), and P(4,7) have a negative polarity. The lines extending in the first direction between the data line D1 and the data line D3, the data line D3 and the data line D5, and the data line D5 and the data line D7 may be visible to the user, and the lines extending in the second direction between the scan line S1 and the scan line S2, the scan line S2 and the scan line S3, and the scan line S3 and the scan line S4 may be visible to the user.

In the first to fourth frames, the line extending in the first direction and the line extended in the second direction may be visible at a viewpoint of the user.

The number of lines that may be visible to the user when the LCD device is driven in the first mode is smaller than the number of lines that may be visible to the user when the liquid crystal display device is driven in the second mode. When a variation of a gray level of each pixel P is equal to or less than a predetermined level for the predetermined number of frames, a luminance difference resulting from a difference in a polarity of the data voltages is not ignored. Accordingly, the case where the liquid crystal display device is driven in the first mode and the case where the liquid crystal display device is driven in the second mode may be discriminated by the user. The number of lines that are visible to the user when the liquid crystal display device is driven in the first mode is less than the number lines that are visible to the user when the liquid crystal display device is driven in the second mode, so that the case where the liquid crystal display device is driven in the first mode is advantageous. However, when the variation of the gray level is equal to or greater than a predetermined level, the image data RGB corresponding to each pixel P is sharply changed, so that a luminance difference resulting from a difference in a polarity of the data voltages may be ignored. Accordingly, the case where the liquid crystal display device is driven in the first mode and the case where the liquid crystal display device is driven in the second mode is not discriminated by the user. In this case, the liquid crystal display device may be driven in the second mode.

Figure 4:
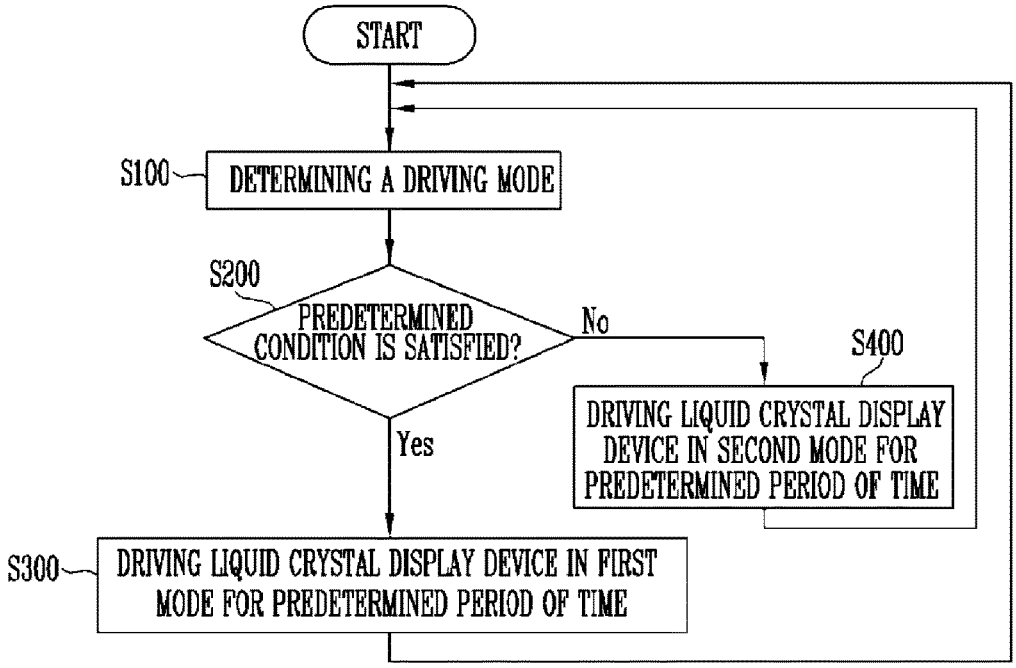
FIG. 4 is a flowchart for describing a driving method of the liquid crystal display device according to an exemplary embodiment of the present invention.

FIG. 4 is a flowchart for describing a driving method of the liquid crystal display device according to an exemplary embodiment of the present invention. The driving method will be described with reference to FIG. 1 to FIG. 4.

In operation S100 of determining a driving mode, the mode determination unit 121 determines a driving mode based on pre-stored image data RGB. When the mode determination unit 121 determines that the liquid crystal display device is driven in a first driving mode, the mode determination unit 121 outputs a mode control signal MCS having a first logic value. When the mode determination unit 121 determines that the liquid crystal display device is driven in a second driving mode, the mode determination unit 121 outputs a mode control signal MCS having a second logic value. An exemplary embodiment of an algorithm for determining the driving mode will be described below with reference to FIG. 5.

When a predetermined condition is satisfied in operation S200, the liquid crystal display device is driven in a first mode (S300). When the predetermined condition is not satisfied, the liquid crystal display device is driven in a second mode (S400).

In operation S300 of driving the liquid crystal display device in the first mode, the polarity information output unit 131 outputs one of six elements of polarity information PInfo1 to PInfo6 constituting a polarity information group PInfo for a predetermined period of time. A level of the data voltage is determined based on one of the polarity information PInfo1 to PInfo6 and the image data RGB, and the data voltage is supplied to the data lines D. When the predetermined period of time ends, operation S100 of determining a driving mode is performed.

In operation S400 of driving the liquid crystal display device in the first mode, the polarity information output unit 131 outputs one of four elements of polarity information PInfo1' to PInfo4' constituting a polarity information group PInfo' for a predetermined period of time. A level of the data voltage is determined based on one of the polarity information PInfo'1 to PInfo'6 and the image data RGB, and the data voltage is supplied to the data lines D. When the predetermined period of time ends, operation S100 of determining a driving mode is performed.

In the exemplary embodiment described with reference to FIG. 4, the liquid crystal display device is driven in the first mode or the second mode, but the liquid crystal display device may be driven only in the first mode.

Figure 5:
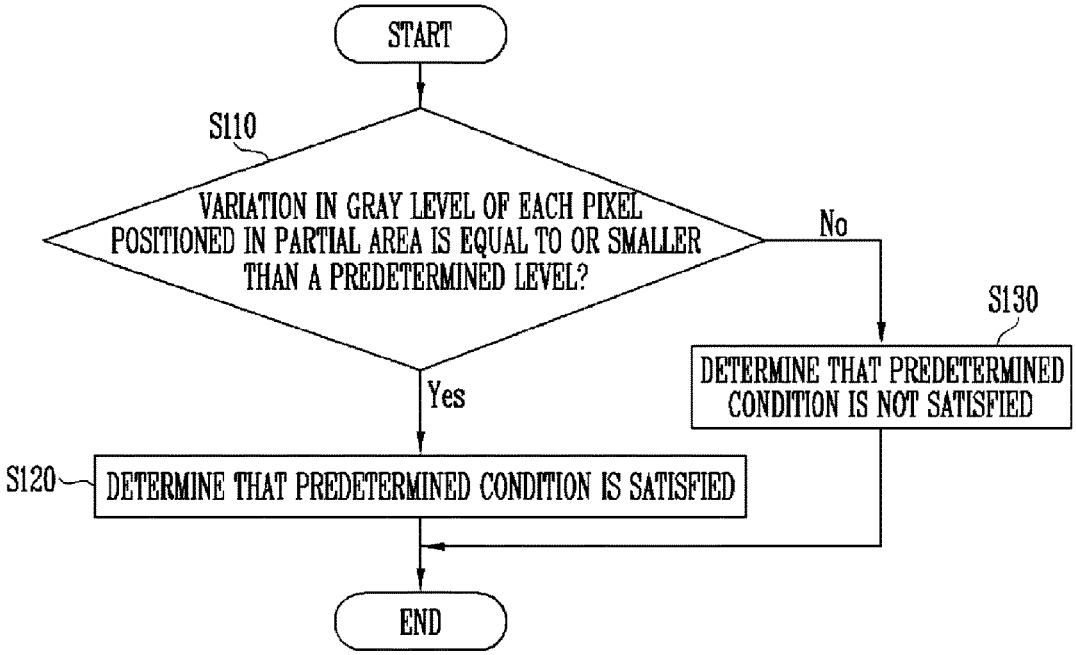
FIG. 5 is a flowchart for describing an operation of determining a driving mode in the method illustrated in FIG. 4.

FIG. 5 is a flowchart for describing an operation of determining a driving mode illustrated in FIG. 4. The operation will be described with reference to FIG. 1 to FIG. 5.

In operation S110 of determining whether stored image data satisfies a predetermined condition, it is determined whether a variation of a gray level of each of the pixels positioned in a partial area among the pixels P is equal to or smaller than a predetermined level. When a variation of a gray level of each of the pixels positioned in a partial area (400×400 pixels in the first and second directions) among the pixels P within the display panel 200 is equal to or smaller than a predetermined level, a user may view a line by a difference in a polarity in the entirety of the partial area, so that it may be determined that a quality of an image displayed to the user is sufficiently degraded. The variation of the gray level may be variously defined, for example, a difference between the largest value and the smallest value among the gray levels corresponding to the respective pixels P and stored in the driver 100 may be defined as the variation. The gray levels corresponding to the respective pixels P may be calculated based on the stored image data RGB, and stored in the driver 100. A method of storing the gray levels may be a first-in first-out method. When the variation of the gray level of each of the pixels positioned in the partial area among the pixels P is equal to or smaller than the predetermined level, it is determined that the predetermined condition is satisfied (S120). When the variation of the gray level of each of the pixels positioned in the partial area among the pixels P is greater than the predetermined level, it is determined that the predetermined condition is not satisfied (S130).

When it is determined that the predetermined condition is satisfied in operation S120, the mode determination unit 121 determines that the image data RGB satisfies the predetermined condition, and outputs the mode control signal MCS having the first logic value. Then, the liquid crystal display device may be driven in the first mode (S300).

When it is determined that the predetermined condition is not satisfied in operation S130, the mode determination unit 121 determines that the image data RGB does not satisfy the predetermined condition, and outputs the mode control signal MCS having the second logic value. Then, the liquid crystal display device may be driven in the second mode (S400).

In the exemplary embodiment described with reference to FIG. 5, the mode control signal MCS may have the first logic value or the second logic value, but the mode control signal MCS may always have the first logic value. In this case, the liquid crystal display device may always be driven in the first mode (S300).

Figure 6A:
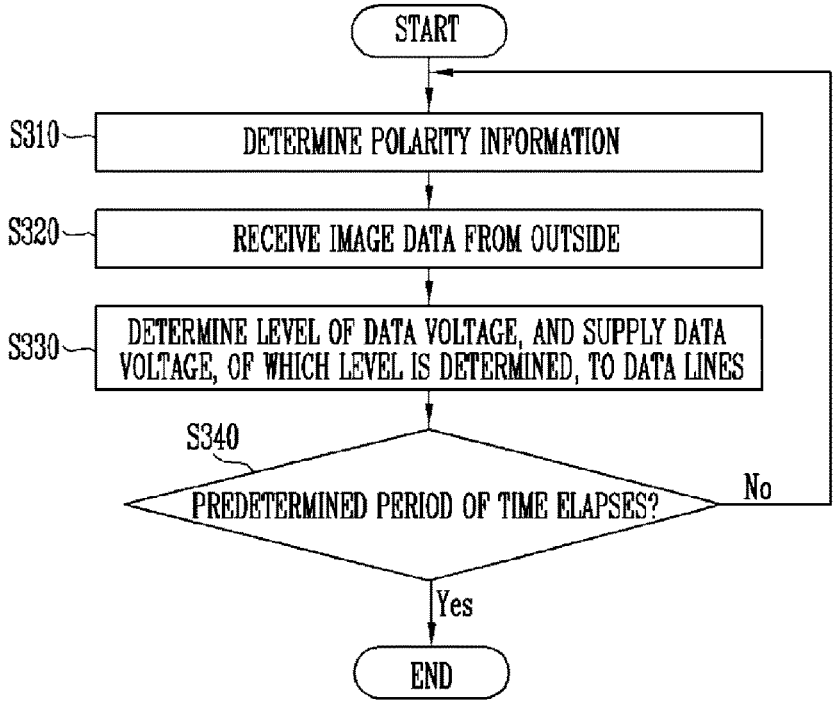
FIG. 6A is a flowchart for describing an operation of driving the liquid crystal display device in a first mode illustrated in FIG. 4.

FIG. 6A is a flowchart for describing an operation of driving the liquid crystal display device in the first mode illustrated in FIG. 4. Hereinafter, the operation will be described with reference to FIG. 1 to FIG. 6A.

Polarity information corresponding to the data lines is determined (S310). The mode control signal MCS having the first logic value is output and the liquid crystal display device is driven in the first mode, so that one of six elements of polarity information PInfo1 to PInfo6 constituting the polarity information group PInfo is output from the polarity information output unit 131. For convenience of the description, it is assumed that the polarity information PInfo1 is output from the polarity information output unit 131. A polarity of the data voltage supplied to the data line D is determined based on the polarity information PInfo1.

The driver 100 receives the image data RGB from the outside (S320).

Levels of the data voltages supplied to the data lines are determined based on the polarity information PInfo1 and the image data RGB, and the data voltage, of which the level is determined, is supplied to the data lines D (S330).

When a predetermined period of time does not elapse in operation S340, operation S310 of determining the polarity information corresponding to the data lines is performed again. When the predetermined period of time elapses, operation S300 of driving the liquid crystal display device in the first mode is terminated, and operation S100 of determining a driving mode may be performed.

Figure 6B:
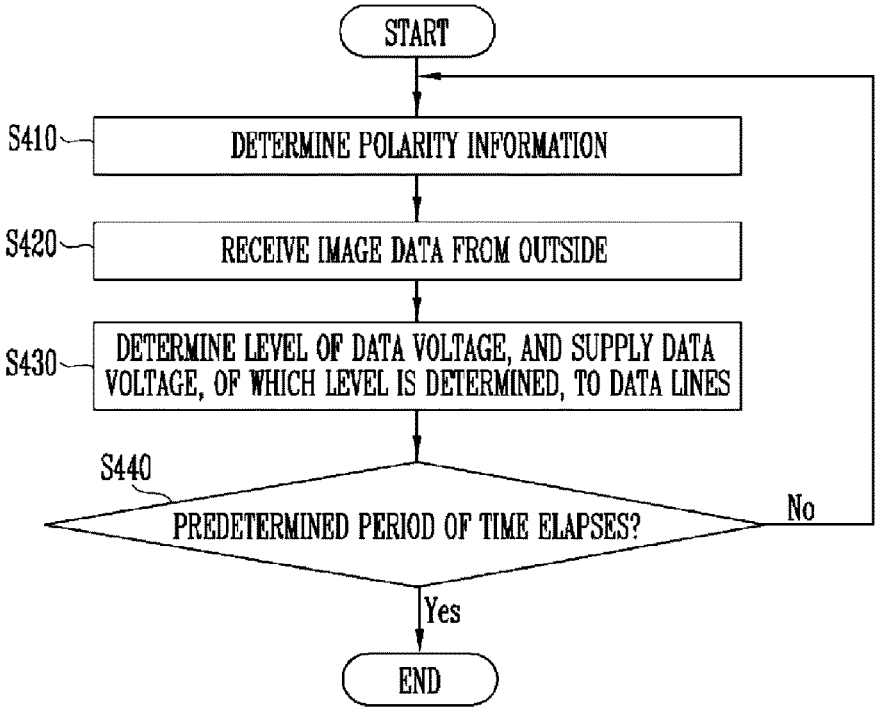
FIG. 6B is a flowchart for describing an operation of driving the liquid crystal display device in a second mode illustrated in FIG. 4.

FIG. 6B is a flowchart for describing an operation of driving the liquid crystal display device in the second mode illustrated in FIG. 4. Hereinafter, the operation will be described with reference to FIG. 1 and FIG. 6B.

Polarity information corresponding to the data lines is determined (S410). The liquid crystal display device is driven in the second mode, so that the polarity information output unit 131 outputs one of four elements of polarity information PInfo'1 to PInfo'4 constituting a polarity information group PInfo'. For convenience of the description, it is assumed that the polarity information PInfo'1 is output from the polarity information output unit 131. Polarities of the data voltages supplied to the data lines D are determined based on the polarity information PInfo'1.

The driver 100 receives the image data RGB from the outside (S420).

Levels of the data voltages supplied to the data lines are determined based on the polarity information PInfo'1 and the image data RGB, and the data voltage, of which the level is determined, is supplied to the data lines D (S430).

When a predetermined period of time does not elapse in operation S440, operation S410 of determining the polarity information corresponding to the data lines is performed again. When the predetermined period of time elapses, operation S400 of driving the liquid crystal display device in the first mode is terminated, and operation S100 of determining a driving mode may be performed.

Software, by which the algorithms are executed, may be embedded in the driver 100, and the algorithms described with reference to FIG. 4 to FIG. 6B are simply one embodiment. For example, whether to drive the liquid crystal display device in the first mode or the second mode may be determined while the image data RGB is recognized in the unit of the frame. Otherwise, the liquid crystal display device may be set to be driven in the first mode only when a still part or a part moving at a predetermined speed is equal to or greater than a predetermined area while the image data RGB is recognized in the unit of the frame.

Summarizing, when a polarity of a data voltage supplied to one pixel is not changed for a long time, crosstalk of an image and a flicker phenomenon may occur. In order to prevent the phenomenon, a polarity of the data voltage supplied to one pixel is change with a predetermined cycle. This is referred to as inversion. However, when polarities of data voltages supplied to adjacent pixels are different, there is a problem in that luminance is different even though gray levels of the adjacent pixels are the same as each other.

The liquid crystal display device according to the present invention and the driving method thereof may relieve the phenomenon in which lines are visible to a user.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A liquid crystal display device, comprising:

pixels;

data lines and scan lines coupled to the pixels; and a driver configured to supply a scan signal to the scan lines, and supply a data voltage to the data lines, wherein:

the data lines include first to sixth data lines, which are adjacent to each other;

in a first frame, the data voltage supplied to each of the first to third data lines has a positive polarity, and the data voltage supplied to each of the fourth to sixth data lines has a negative polarity; and in a second frame displayed right after the first frame, the data voltage supplied to each of the second to fourth data lines has a positive polarity, and the data voltage supplied to each of the first, fifth, and sixth data lines has a negative polarity.

2. The liquid crystal display device of claim 1, wherein, in a third frame displayed right after the second frame, the data voltage supplied to each of the third to fifth data lines has a positive polarity, and the data voltage supplied to each of the first, second, and sixth data lines has a negative polarity.

3. The liquid crystal display device of claim 2, wherein:

in a fourth frame displayed right after the third frame, the data voltage supplied to each of the fourth to sixth data lines has a positive polarity, and the data voltage supplied to each of the first to third data lines has a negative polarity;

in a fifth frame displayed right after the fourth frame, the data voltage supplied to each of the first, fifth, and sixth data lines has a positive polarity, and the data voltage supplied to each of the second to fourth data lines has a negative polarity; and in a sixth frame displayed right after the fifth frame, the data voltage supplied to each of the first, second, and sixth data lines has a positive polarity, and the data voltage supplied to each of the third to fifth data lines has a negative polarity.

4. The liquid crystal display device of claim 1, wherein:

the data lines extend in the first direction, and the scan lines extend in a second direction crossing the first direction; and each pixel is included in one of pixel groups, and each pixel group comprises:

a first pixel for displaying a first color;

a second pixel, which displays a second color, is coupled to the same scan line as that of the first pixel, and is adjacent to the first pixel in the second direction;

a third pixel, which displays a third second color, is coupled to the same data line as that of the first pixel, and is adjacent to the first pixel in the first direction; and a fourth pixel, which displays a fourth color, is coupled to the same data line as that of the second pixel, and is coupled to the same scan line as that of the third pixel.

5. The liquid crystal display device of claim 4, wherein the data line coupled to the first pixel of each pixel group is coupled to the first pixel of the pixel group adjacent to each pixel group in the first direction.

6. The liquid crystal display device of claim 4, wherein the scan line coupled to the first pixel of each pixel group is adjacent to the scan line coupled to the first pixel of the pixel group adjacent to each pixel group in the second direction.

7. The liquid crystal display device of claim 1, wherein:

the driver comprises a polarity information output unit for outputting polarity information corresponding to the data lines; and a polarity of the data voltage supplied to each of the first to sixth data lines is determined based on the polarity information.

8. The liquid crystal display device of claim 7, wherein the polarity information is one of six elements of polarity information constituting a polarity information group.

9. The liquid crystal display device of claim 1, wherein:

the driver further comprises a mode determination unit for determining a driving mode; and when the mode determination unit outputs a mode control signal having a first logic value, the data voltage supplied to each of the first to third data lines has a positive polarity, and the data voltage supplied to each of the fourth to sixth data lines has a negative polarity.

10. A liquid crystal display device, comprising:

pixels;

data lines and scan lines coupled to the pixels; and a driver configured to supply a scan signal to the scan lines, and supply a data voltage to the data lines, wherein:

the data lines include first to sixth data lines, which are adjacent to each other; and in a first frame, the data voltage supplied to each of the first to third data lines has a positive polarity, and the data voltage supplied to each of the fourth to sixth data lines has a negative polarity;

the driver further comprises a mode determination unit for determining a driving mode;

when the mode determination unit outputs a mode control signal having a first logic value, the data voltage supplied to each of the first to third data lines has a positive polarity, and the data voltage supplied to each of the fourth to sixth data lines has a negative polarity; and when the mode determination unit outputs a mode control signal having a second logic value, the data voltage supplied to each of the first, second, fifth, and sixth data lines has a positive polarity, and the data voltage supplied to each of the third and fourth data lines has a negative polarity.

* * * * *